US006634921B1

(12) United States Patent
Coulthard, Jr.

(10) Patent No.: US 6,634,921 B1
(45) Date of Patent: Oct. 21, 2003

(54) GAS BAG DISPENSING TOY AND METHOD

(75) Inventor: Robert Stanley Coulthard, Jr., Lynn Haven, FL (US)

(73) Assignee: Common Sense Systems, Inc., Lynn Haven, FL (US)

( * ) Notice: Subject to any disclaimer, the term of this patent is extended or adjusted under 35 U.S.C. 154(b) by 0 days.

(21) Appl. No.: 10/197,523

(22) Filed: Jul. 18, 2002

(51) Int. Cl.[7] ..... A63H 3/06
(52) U.S. Cl. ..... 446/221; 206/804
(58) Field of Search ..... 446/220, 221, 446/71, 73, 75, 77, 180–181, 397, 182; 206/804, 446, 522, 554

(56) References Cited

U.S. PATENT DOCUMENTS

| | | | | |
|---|---|---|---|---|
| 1,651,289 | A | * | 11/1927 | O'Clair |
| 2,273,644 | A | | 2/1942 | Hope |
| 3,288,327 | A | * | 11/1966 | Cahlik |
| 3,333,360 | A | | 8/1967 | Hardy |
| 3,399,762 | A | * | 9/1968 | Potter |
| 4,378,391 | A | | 3/1983 | Allen |
| 4,848,743 | A | | 7/1989 | Rozek |
| 4,911,671 | A | | 3/1990 | Rogers |
| 5,183,157 | A | * | 2/1993 | Darden ..... 206/390 |
| 5,191,996 | A | | 3/1993 | Jenkins |
| 5,427,246 | A | * | 6/1995 | Hadjikhani ..... 206/554 |
| 5,467,894 | A | * | 11/1995 | Altonen et al. ..... 221/71 |
| 5,484,318 | A | | 1/1996 | Mayert et al. |
| 5,681,203 | A | | 10/1997 | Arnold |
| 5,865,664 | A | | 2/1999 | Martey |
| RE36,759 | E | | 7/2000 | Hoover et al. |
| 6,209,286 | B1 | | 4/2001 | Perkins et al. |
| 6,270,006 | B1 | | 8/2001 | Bright et al. |
| 6,283,762 | B1 | | 9/2001 | Wiggins |

* cited by examiner

*Primary Examiner*—Jacob K. Ackun
*Assistant Examiner*—Jamila Williams
(74) *Attorney, Agent, or Firm*—Jones, Tullar & Cooper, PC

(57) ABSTRACT

An amusement or stress reduction method and device adapted to dispense gas bags for popping. A strip of material is attached to one end of a tubular container and a plurality of gas bags are inserted serially into the container, causing the strip of material to loop under the plurality of gas bags in a U-shaped manner. The second end of the strip of material is located adjacent to the secured end at the container opening. A user pulls the free end of the strip to forcibly eject one or more gas bags from the container. The bags can then be popped by stomping or the like. Various configurations, markings, and constructions can be used with the gas bags, container, and strip.

19 Claims, 1 Drawing Sheet

GAS BAG DISPENSING TOY AND METHOD

BACKGROUND OF THE INVENTION

1. Field of the Invention

The present invention relates to toys and, more particularly, to a toy for dispensing gasfilled bags for amusement purposes.

2. Description of the Related Art

It is known to provide horns, clappers, bells, and other noisemakers for both stress reduction and amusement for sporting events, celebrations, parties, and the like. However, these devices often do not rise to the instant gratification, amusement, and stress relief provided by forcibly causing a loud noise by a destructive act. Therefore, while known noisemakers may be suitable for the particular purposes to which they address, they do not fully satisfy specific recreational and stress reduction requirements.

One related, classic, and almost inexplicable form of amusement or stress reduction is to pop a balloon or balloons. The associated loud "popping" noise or "bang" is often amusing to children and generally allows people to release destructive energy in a safe and harmless manner.

A similar common means for amusement or stress reduction involves bursting or destroying the individual bubbles in sheets of bubble packing material. Sheets of bubble packing material have numerous small bubbles that can be bursted by squeezing or crushing. The noise associated with popping the bubbles provides amusement to children, and the action of popping the bubbles provides a harmless outlet for stress for both children and adults. For this and other reasons, "bubble sheets" have been incorporated into inventions as stress reduction and amusement devices, including U.S. Pat. Nos. 5,681,203, 4,848,743, 5,865,664 and 5,484,318. However, the associated noise is relatively quiet in comparison to that made by popping balloons or larger air containers, and, normally, only one person at a time can burst the bubbles in the packing material.

Typically, the bubble packing sheet used in the above-listed inventions is a sheet of polymeric material with a plurality of small gas filled pockets or bubbles. The flexible bubble sheet can be wrapped around packaged goods in order to provide a protective, cushioning layer of gas. But, as mentioned above, the material often provides a secondary purpose upon delivery of a package as recipients can amuse themselves by bursting the bubbles in the packing material.

Another recent packing material development is the use of larger gas bags or gas pillows. These gas bags used for shipping are generally are produced in a connected or sheet-like form, and are used to fill the void between goods being shipped and the wall or inner surface of a shipping package. This helps to prevent the goods from shifting within the shipping package and provides a large volume of trapped gas to act as a cushion for the goods. These gas bags can be separated from each other to form distinct gas-filled packets. When popped, these gas packing bags generally produce a sound that is much louder than that produced by popping the smaller air pockets on bubble packing material. Moreover, several people or children can destroy the larger gas bags simultaneously.

Presently, there does not exist a toy or stress reduction device that dispenses shipping gas bags or other gas bags for amusement or stress relief. Therefore, there exists an opportunity and need to incorporate gas bags into a novel storage and dispensing apparatus to form a new amusement and stress reduction toy.

SUMMARY OF THE INVENTION

In accordance with this invention, a gas bag toy including a storage container and dispensing mechanism is provided which allows individual or multiple gas bags to be dispensed for destruction. The invention includes three primary components: one or more gas bags; a tubelike container for containing the gas bags; and a strip of material roughly twice the length of the container's interior for use in dispensing the gas bags from the container. The strip of material is placed in the interior of the container in a generally U-shaped configuration and the gas bags are aligned serially within the container and the strip of material. One end of the strip of material is secured to an open end of the container and the other end of the strip of material exits from the same end of the container, but is not secured. As the gas bags rest within the U-shaped portion of the strip of material, pulling on the free end of the ribbon dispenses individual bags from the open end of the container. The bags can then be destroyed by applying pressure to burst the bag, such as by stamping a bag under foot.

In one embodiment, the gas bags are individual gas-filled cells or pillows typically used as packaging material. The gas bags may be pillow-shaped and approximately two inches by two inches in size, with the container having an inner diameter that is slightly less than the diameter of the gas bags. In this manner, the gas bags may be pressed into the container and the friction created by the slight compression of the bags retains the bag within the container until such time as it is desired to dispense the bags. The strip of material comprises a string, ribbon, or other flexible elongate material. The container can be constructed from a material such as paper, plastic, or cardboard that is preferably inexpensive or even disposable.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 2B:
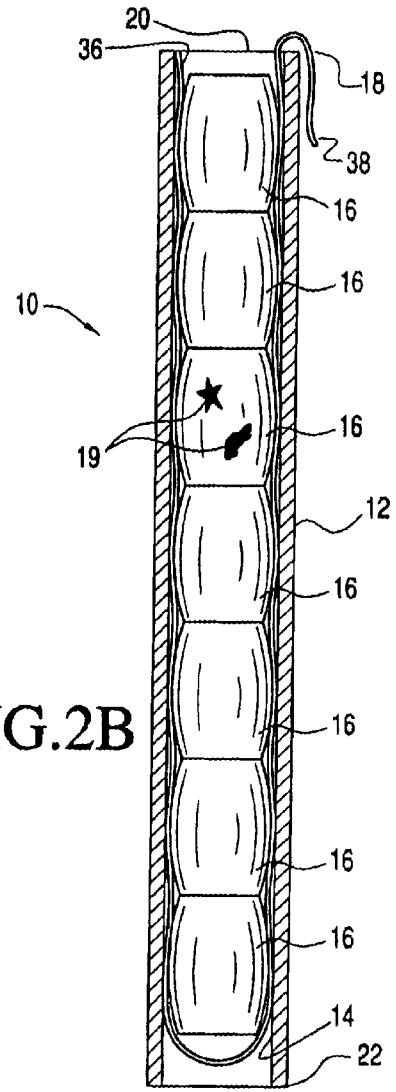
FIG. 2*b* illustrates the invention of FIG. 2*a*, showing the gas bags loaded into the container.
Figure 2A:
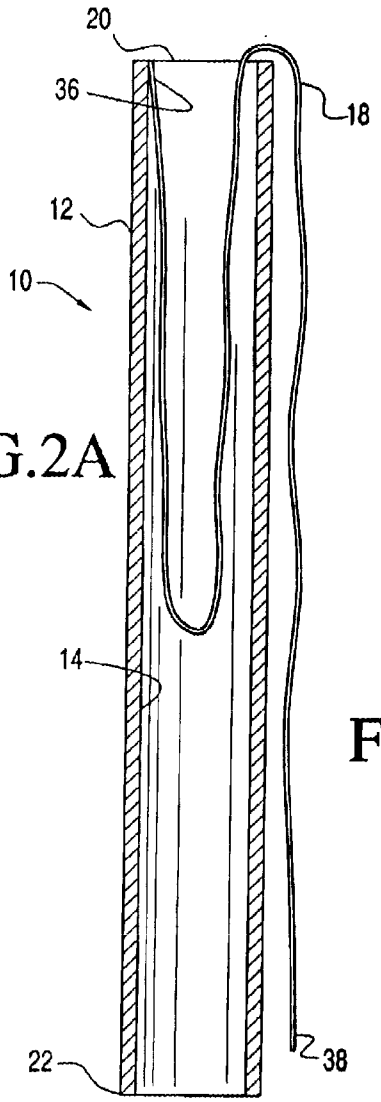
FIG. 2*a* is an enlarged plan cross section view of the invention of FIG. 1, showing the container in its empty condition.
Figure 1:
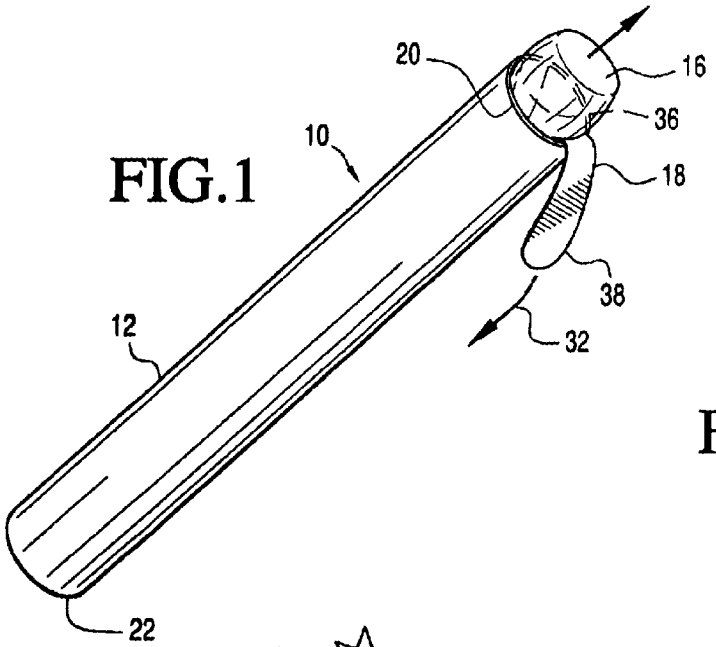
FIG. 1 is a perspective view of a first embodiment in accordance with the present invention.
Figure 3:
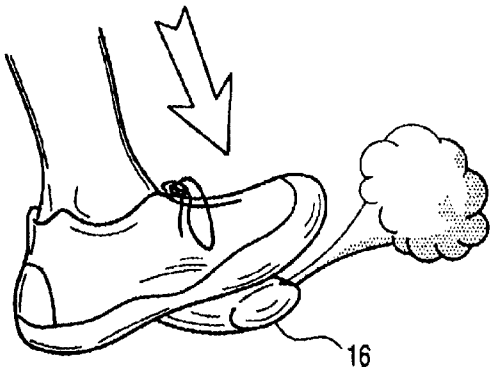
FIG. 3 illustrates a gas bag of the invention being popped for amusement.

FIG. 1 illustrates a first embodiment of a gas bag dispensing toy 10. As also illustrated in FIGS. 2*a* and 2*b*, toy 10 includes an elongated container 12 having an elongated, hollow, preferably tubular or cylindrical interior 14 for receiving and containing one or more gas bags 16 therein. Gas bags 16 may be dispensed from container 12 by pulling on a ribbon or strip 18, which forces gas bags 16 out of container 12 in a manner that will be described in more detail below. Once a gas bag 16 has been dispensed from container 12, it may be popped by stomping, or otherwise crushing gas bag 16, as illustrated in FIG. 3.

Gas bags 16 can be air bags or air pillows such as are commonly used for packing material. That way, after bags 16 are dispensed from toy 10 by the means described below, toy 10 can be refilled by using appropriately sized air bags 16 purchased separately as refills. The preferred bags 16 are made from a plastic film by known methods, such as are described in U.S. Pat. No. 5,942,076 to Salerno et al. However, gas bags 16 may also be specifically shaped or labeled depending on a particular desired use. Therefore, gas bags 16 could be shaped like a human foot, head, an animal, or some other likeness. Bags 16 could also carry licensed trademarks or other markings as desired. Also, gas bags 16 could contain prizes 19, toys, candy, or the like, so that when gas bags 16 are crushed or popped, prizes 19 may be retrieved from the interior thereof. Gas bags 16 may also be filled with any number of gases, and could include specific scents, perfumes, or other additives that are released when gas bags 16 are popped.

Container 12 of the preferred embodiment is an elongate, straight, tubular conduit with at least one open end 20. The opposite end 22 may also be open, or may have a cover or cap (not shown). To limit costs, container 12 of the preferred embodiment may be made from plastic, paper or cardboard. Container 12 may also be made from other suitable materials and may include markings, writings, decorations, or the like. In one embodiment, container 12 may be marked to resemble a stick of dynamite or TNT. Also, container 12 may have an exterior shaped like a gun, cannon, or other device or object, and may include handles, grips, or other accessories to facilitate holding and using toy 10. As will be apparent to those skilled in the art, other shapes or configurations may also be suitable for container 12 so long as gas bags 16 can be dispensed properly.

In one embodiment, container 12 is a standard cardboard tube and bags 16 are approximately two inch by two inch air-inflated polymer bags. Interior 14 of container 12 is sized so that gas bags 16 fit within interior 14 in such a manner that they are slightly compressed when inserted. This creates a frictional engagement between gas bags 16 and interior 14 of container 12 so that gas bags 16 will be frictionally retained within container 12 until it is desired to dispense gas bags 16.

Dispensing of gas bags 16 is generally accomplished by pulling on a strip of material 18, as illustrated by arrow 32 in FIG. 1. Strip 18 can be constructed from a number of materials so long as the material is resistant to child play and sufficiently flexible and durable. To facilitate use of the full length of container 12, strip 18 should be slightly more than twice as long as the length of interior 14. Almost any flat tape, ribbon, cloth, polymer strip, composite strip, or string would be suitable. For example, strip 18 might be constructed from plastic sheet material or the composite material sold under the brand name Tyvek®. Also, strip 18 may be decorated as desired, or in accordance with any markings on container 12, as described above. For example, if container 12 resembles a stick of dynamite, strip 18 might resemble a fuse.

Strip 18 is installed in container 12 by securing a first end 36 of strip 18 to the side of container 12 at or near open end 20 of container 12. Securing first end 36 of strip 18 can be accomplished by a variety of means including staples, glue, rivets or the like. Strip 18 is then placed over the open end 20 of container 12 so that the free end 38 of strip 18 is positioned outside of container 12.

Gas bags 16 may then be inserted into interior 14 of container 12 by placing gas bags 16 on top of strip 18 and pushing bags 16 into interior 14. Additional gas bags 16 are added sequentially to interior 14 in such a manner so as to stack gas bags 16 down the length of interior 14. This also pushes strip 18 down into interior 14 of container 12, thereby looping strip 18 under bags 16 in a U-shaped configuration. Strip 18 is of a sufficient length so that it can extend from a secured first end 36, down interior 14, loop under or behind all bags 16, and back to open end 20, with a sufficient amount of the free end 38 protruding from open end 20 so that strip 18 may be gripped by a user. Free end 38 of strip 18 is thus freely located adjacent the secured end 36 of strip 18 and the free end 38 is accessible to a user.

In use, a user holds container 12 and exerts a force on the free end 38 of strip 18 to operate toy 10. The operation of pulling strip 18 from interior 14 of container 12 will result in the ejection one or more bags 16, depending on the distance which strip 18 is pulled. A relatively short pull will dispense as little as one bag 16. Longer pulls will dispense a plurality of bags 16. One example of operation includes container 12 being gripped horizontally between a user's forearm and side. The user's other hand would grasp the free end 38 of strip 18. The user would pull strip 18, releasing bags 16. Once bags 16 are free from container 12, they will fall to the ground, preferably a hard surface, and one or more users can then stomp on bags 16 to burst them, as illustrated in FIG. 3, thereby causing a loud bang or popping sound.

In a possible alternative embodiment, container 12 may have strips 18 mounted on both ends. This will enable gas bags 16 to be ejected from either end of container 12. Also, the interior 14 of container 12 need not be cylindrical, but may have a square, triangular, or other cross-sectional shape. Thus, while the invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility. The foregoing description of the invention is necessarily of a detailed nature so that a specific embodiment of its best known mode might be set forth as required, but it is to be understood that various modifications of detail, rearrangement, and multiplication of parts might be possible without departing from the spirit and essences of the invention, as developed in the claims below.

What is claimed:

1. A toy comprising:

a tube, said tube having an interior and at least one opening in communication with said interior;

a plurality of gas bags containing a pressurized gas, said plurality of gas bags positioned in said interior of said tube in a serial arrangement;

a strip of material having a first end, said first end of said strip being secured to said tube adjacent said one opening, said strip being configured within said interior of said tube in a generally U-shaped configuration with said strip looped under said plurality of gas bags within said interior of said tube; and a second end of said strip located at said one opening in said tube, said second end of said strip being accessible to a user whereby a pulling force on said second end of said strip will pull said gas bags out of said tube interior.

2. The toy of claim 1, wherein said bags are sized relative to the interior of said tube so as to frictionally engage the inside wall of said tube when inserted into said tube.

3. The toy of claim 1, wherein said tube is a cylindrical.

4. The toy of claim 1, wherein said strip is a polymeric sheet material.

5. The toy of claim 1, wherein said strip is a string.

6. The toy of claim 1, wherein said gas bags are polymeric bags and said pressurized gas is pressurized air.

7. The toy of claim 6, wherein the air in said gas bags includes a specific scent.

8. The toy of claim 6, wherein said gas bags include prizes contained therein.

9. A toy comprising:

a container, said container having an elongate tubular interior with at least one opening on an end of said container;

at least one gas bag containing a pressurized gas, said at least one gas bag being located within said tubular interior; and a strip, said strip having an end and being configured within said interior in a generally Ushaped configuration whereby pulling said end of said strip out of said interior of said container will force said at least one gas bag from said interior.

10. The toy of claim 9, wherein said at least one gas bag is sized relative to said interior so as to frictionally engage said interior when located within said interior.

11. The toy of claim 9, wherein said container is a cylindrical tube.

12. The toy of claim 9, wherein said strip is a polymeric sheet material.

13. The toy of claim 9, wherein one end of said strip is secured to said container near said opening.

14. The toy of claim 9, wherein said pressurized gas in said at least one gas bag is pressurized air and said at least one gas bag is a polymeric bags.

15. The toy of claim 14, wherein said pressurized air in said at least one gas bag includes a specific scent.

16. The toy of claim 14 wherein said at least one gas bag includes a prize contained therein.

17. A method for providing amusement comprising:

providing a container, said container having a tubular interior and an open end;

providing a plurality of gas bags in said container;

placing a flexible strip in said container, said strip having a first end;

positioning said first end of said strip near said open end of said container;

configuring said strip within said interior in a generally U-shaped configuration;

looping said strip under said plurality of gas bags within said interior of said container;

projecting a second end of said strip from said open end of said container;

affording access to said second end of said strip to a user;

pulling said second end of said strip and ejecting at least one of said gas bags from said container; and crushing said ejected one of said plurality of gas bags to produce a popping noise.

18. The method of claim 17, further including the step of providing the gas in said gas bag with a specific scent which scent is released when said gas bag is crushed.

19. The method of claim 17, further including the step of providing a prize within the interior of said gas bag, which prize will become accessible when said gas bag is crushed.

* * * * *